US005782956A

United States Patent [19]

Janke et al.

[11] Patent Number: 5,782,956

[45] Date of Patent: Jul. 21, 1998

[54] CASTING FLUX

[75] Inventors: Dieter Janke, Erkrath; Peter Hammerschmid, Dusseldorf, both of Germany

[73] Assignees: Max Planck Institut fur Eisenforschung GmbH, Dusseldorf; Stollberg GmbH, Oberhausen, both of Germany

[21] Appl. No.: 952,757

[22] PCT Filed: Feb. 7, 1992

[86] PCT No.: PCT/EP92/00272

§ 371 Date: Nov. 18, 1994

§ 102(e) Date: Nov. 18, 1994

[87] PCT Pub. No.: WO92/13661

PCT Pub. Date: Aug. 20, 1992

[30] Foreign Application Priority Data

Feb. 8, 1991 [DE] Germany ..... 41 03 798.7
Feb. 7, 1992 [WO] WIPO ..... PCT/EP92/00272

[51] Int. Cl.[6] ..... C22B 9/10

[52] U.S. Cl. ..... 75/305; 75/323; 75/329

[58] Field of Search ..... 75/531, 520, 518, 75/305, 323, 329

[56] References Cited

U.S. PATENT DOCUMENTS

| | | | |
|---|---|---|---|
| 3,899,324 | 8/1975 | Corbett . | |
| 3,926,246 | 12/1975 | Corbett et al. . | |
| 3,964,916 | 6/1976 | Armistead | 75/305 |
| 4,092,159 | 5/1978 | Uher . | |
| 4,235,632 | 11/1980 | Uher et al. | 75/305 |
| 4,508,571 | 4/1985 | Nakato | 75/305 |
| 5,028,257 | 7/1991 | Tomkins | 75/305 |
| 5,356,454 | 10/1994 | Itoyama | 75/305 |
| 5,366,535 | 11/1994 | Heaslip et al. | 75/305 |

FOREIGN PATENT DOCUMENTS 0015417 9/1980 European Pat. Off. .

OTHER PUBLICATIONS

P. Hammerschmid et al. "Untersuchungen vur . . . Giesspulver", vol. 111, No. 9, Sep. 13, 1991, Dusseldorf, pp. 97–100.

*Primary Examiner*—Melvyn Andrews
*Attorney, Agent, or Firm*—Meltzer, Lippe, Goldstein, et al.

[57] ABSTRACT

The invention relates to a casting flux for steels or alloys on an iron, nickel or cobalt basis which make heavy demands on the degree of oxidic purity for continuous or ingot casting and contain as the main components calcium oxide (CaO), aluminium oxide ($Al_2O_3$) and strontium oxide (SrO), the characterizing feature of the invention being that the chemical composition lies within the following limits (in % by weight):

20 to 40% CaO,
15 to 30% SrO,
0 to 6% Mgo,
0 to 8% $MgF_2$,
0 to 8% $CaF_2$,
0 to 8% NaF
0 to 6% LiF
residue $Al_2O_3$, the flux having a total content not exceeding 15% of oxygen-yielding compounds, such as $SiO_2$, FeO, MnO, $K_2O$, $Na_2O$, $P_2O_5$, $Cr_2O_3$ and $B_2O_3$.

6 Claims, 1 Drawing Sheet

CASTING FLUX

The invention relates to a casting flux for steels or alloys on an iron, nickel or cobalt basis which makes heavy demands on the degree of oxidic purity for continuous or ingot casting. The term casting flux in this case also includes powders for the capping and after-treatments of metal melts in ladles or intermediate vessels.

The casting fluxes hitherto used in practice are built up on a silicate basis, containing as main component 20 to 40% by weight $SiO_2$, in addition to CaO and $Al_2O_3$. In connection with $Na_2CO_3$ and $CaF_2$ and in some circumstances $B_2O_3$, in addition to other important properties the low melting temperature required for casting is set below 1200° C., the necessary viscosity being in the range of approximately 1 Pa.s, with a vitreous state at temperatures below 800° C. In addition these casting fluxes also contain other oxides, such as iron and manganese oxide and also $P_2O_5$, which are introduced via the raw materials. In some cases they are also deliberately added to obtain the aforementioned properties to the required extent. Casting fluxes are also used in industry which in order to maintain a vitreous solidification up to as low temperatures as possible contain increased $SiO_2$ contents with a low $CaO/SiO_2$ ratio below 1.0, to prevent crystalline precipitations, for example, cuspidin or nephelin, from the vitreously solidifying casting slag in the casting gap.

Due to their relatively low thermodynamic formation energy, these casting fluxes on a silicate basis with additions of $Na_2CO_3$ and in some cases $B_2O_3$ and also iron and manganese oxides have a considerable oxidation potential in relation to steels and alloys on an iron, cobalt and metal basis with a low oxygen content. Reaction with alloying elements, such as aluminium, titanium and others causes non-metallic inclusions in the solidified metal due to which the degree of oxidic purity and therefore the properties of use of these metals may considerably deteriorate. Hitherto there has been no technically feasible way of achieving the necessary low oxidation potential of the components of the casting flux without abandonment of the components hitherto used, which more particularly effect vitreous solidification down to low temperatures.

U.S. Pat. No. 3,926,246 discloses the addition of controlled proportions of alkali metal oxides and phosphorus pentoxide in addition to the components normally found in casting fluxes, such as fluorides, alkaline earth oxides, aluminium oxide, silicon oxide, lithium oxide and boron oxide. The result is a substantial and in the case of certain compositions a complete vitrification of the casting flux slag, while maintaining flowability, softening behaviour and aluminium oxide absorptivity. However, although the very high additions of alkali oxides, phosphorus pentoxide, silicon oxide and boron oxide, for example, 18–24% $Na_2O$ or 40% $P_2O_5$ and 25% $SiO_2$ alongside 20% $P_2O_5$ ensure the required vitrification of the casting slag, while maintaining the other aforementioned properties, they lead to a heavy yield of oxygen from the casting slag to the liquid steel, thereby causing a considerable deterioration in the degree of purity of the continuously or ingot cast steel by the formation of non-metallic inclusions.

Similarly to the known casting fluxes, known distributor capping bodies and ladle stopper slags consist of silica or basic oxides and, just like the casting fluxes, have a considerable oxidation potential in relation to steels and alloys on an iron, cobalt and nickel basis with a low oxygen content. Thus, when these ancillary materials are used, the reaction with the alloying elements, such as aluminium, titanium, non-metallic inclusions contained in the steel produces in the liquid metal inclusions which enter the chill mould during the subsequent casting process and lead to a contamination of the metal.

In contrast, it is an object of the invention to develop a metallurgical ancillary material in powder form which has a reduced oxidation potential in comparison with the known ancillary materials, but nevertheless meets the demands made on the slags used in the production of steel.

This problem is solved according to the invention by a casting flux which has 20 to 40% CaO,
15 to 30% SrO,
0 to 6% MgO,
0 to 8% $MgF_2$,
0 to 8% $CaF_2$,
0 to 8% NaF
0 to 6% LiF
residue $Al_2O_3$, and has a total content not exceeding 15%, preferably not exceeding 5%, of oxygen-yielding compounds, such as $SiO_2$, FeO, MnO, $K_2O$, $Na_2O$, $P_2O_5$, $Cr_2O_3$ and $B_2O_3$. According to the invention the total content of the oxygen-yielding compounds must not exceed 15%, since otherwise a transfer of oxygen from the casting slag to the metal melt takes place, resulting in the formation of undesirable non-metallic inclusions in the solidified metal alloy.

BRIEF DESCRIPTION OF THE DRAWING

The sole drawing

Figure 1:
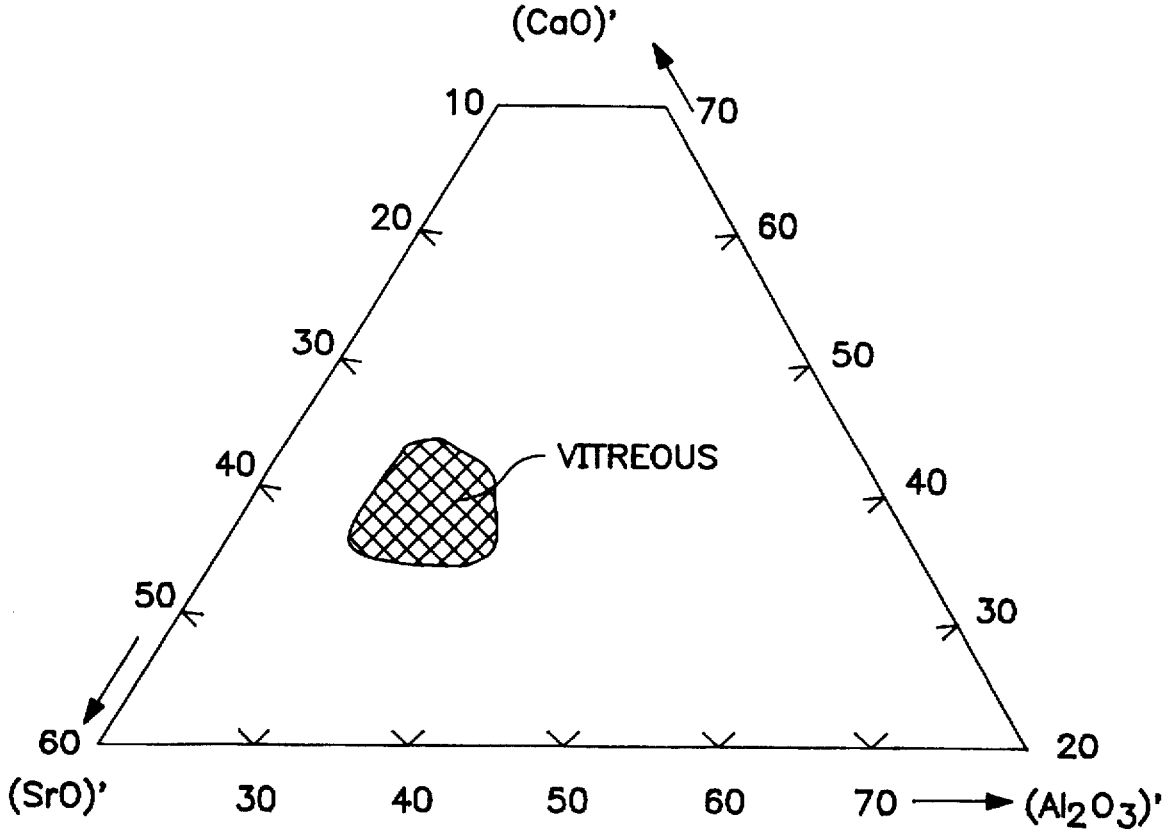
FIG. 1 is a diagram depicting a ternary system of main components CaO, $Al_2O_3$ and SrO of the casting flux. The diagram includes a hatched area.

In the case of metals which are particularly sensitive to non-metallic inclusions, such as aluminium-killed deep-drawing quality steels for outer skin components or metals with alloying components having a high affinity for oxygen, such as titanium-stabilized austenitic steels, the total contents-of oxygen-yielding compounds in the casting flux must be limited to a maximum of 3%.

Normally various amounts of carbon are added to the mixture according to the invention, in dependence on the casting process.

The invention substantially dispenses with the addition of oxygen-yielding additives, without any adverse effect on vitrification and the other standard properties of casting flux. The limitation of the compounds even produces a stable vitreous state during cooling. It must be specially pointed out that by the composition according to the invention, vitrification is achieved without alkali oxides, $B_2O_3$ and $SiO_2$. Alkali, iron and manganese oxides have a high oxygen potential in comparison with the other oxygen-yielding oxides, so that it is convenient to limit each of these compounds to no more than 5%, but preferably no more than 2%.

As already stated, more particularly when the ancillary material is used in the form of a casting flux, it is very important to maintain the vitreous state of the casting slag in the casting gap between the chill mould and the solidified strand shell, without the possibility of crystalline precipitations forming which cause faults in the strand shell. This can be done particularly successfully if the chemical composition of the three main components CaO', $Al_2O_3$' and SrO' lies in the hatched area of the ternary system shown in FIG. 1. This vitrification could not be readily expected, since it occurs only to a very limited extent in lime-aluminate melts.

The addition of very low $SiO_2$ contents can appreciably enhance vitrification without substantially raising the oxygen potential. This is more particularly of great importance, since hitherto the vitreous state of the casting slags has been possible only on a silicate basis.

The invention will now be explained by an example of comparison between a known casting flux and a casting flux according to the invention (Table 1).

TABLE 1

| | Comparison Example % by weight | Example according to the invention % by weight |
|---|---|---|
| $SiO_2$ | 35.5 | 0.3 |
| CaO | 23.5 | 26.9 |
| $Al_2O_3$ | 6.0 | 27.0 |
| MgO | 0.9 | 3.1 |
| $Na_2O$ | 5.0 | 0.2 |
| $CaF_2$ | 11.1 | 4.0 |
| $Fe_2O_3$ | 1.1 | 0.2 |
| C uncombined | 4.5 | 5.5 |
| SrO | | 21.1 |
| $MgF_2$ | | 3.7 |
| NaF | | 3.5 |
| LiF | | 2.3 |
| FeO | | 0.1 |
| MnO | | 0.1 |
| Annealing loss | 12.4 | 2.0 |
| Liquidus temperature (°C.) | 1187 | 1162 |
| Viscosity (Pa.s) at 1300° C. | 0.73 | 0.15 |

Using the two casting fluxes, aluminium-killed deep-drawing quality steel for the outer skin parts of motor cars having the following prescribed chemical composition: max. 0.04% C, 0.15 to 0.22% Mn, 0.030 to 0.050% $Al_{sol.}$ was continuously cast in the form of slabs in a sequence of 300 t melts each, rolled into cold rolled coils and investigated during inspection for faults close to the surface due to the casting techniques. In the case of the coils originating from the melts cast with the casting flux according to the invention, rejections due to outer skin part faults were reduced to one fifth of the quality faults found in parts cast using the known casting flux. In addition to the higher profit to the steel manufacturer, this means that further processers have reduced storage costs.

We claim:

1. A casting flux contains CaO, $Al_2O_3$ and SrO suitable for use with steels or alloys based on iron, nickel, or cobalt, consisting essentially of, in % by weight, 20 to 40% CaO, 15 to 30% SrO, 0 to 6% MgO, 0 to 8% $MgF_2$, 0 to 8% $CaF_2$, 0 to 8% NaF, 0 to 6% LiF, balance $Al_2O_3$, said flux having no more than 15% by weight of an oxygen-yielding compound selected from the group consisting of $SiO_2$, FeO, $Fe_2O_3$, MnO, $K_2O$, $Na_2O$, $P_2O_5$, $Cr_2O_3$, $B_2O_3$ and combinations thereof.

2. The casting flux of claim 1 having no more than 5% by weight of said oxygen-yielding compound.

3. The casting flux of claim 1 having no more than 3% by weight of said oxygen-yielding compound.

4. The casting flux of claim 1 wherein the alkali, iron, and manganese oxide contents are each no greater than 5% by weight.

5. The casting flux of claim 1 wherein the alkali, iron, and manganese oxide contents are each no greater than 2% by weight.

6. The casting flux of claim 1 having an SrO content of 15 to 20% by weight.

* * * * *